US011454260B2

(12) United States Patent
Clausen

(10) Patent No.: US 11,454,260 B2
(45) Date of Patent: Sep. 27, 2022

(54) HYDRAULIC ACTUATOR ARRANGEMENT

(71) Applicant: PistonPower ApS, Sonderborg (DK)

(72) Inventor: Jørgen Mads Clausen, Sonderborg (DK)

(73) Assignee: PistonPower ApS, Soenderborg (DK)

( * ) Notice: Subject to any disclaimer, the term of this patent is extended or adjusted under 35 U.S.C. 154(b) by 7 days.

(21) Appl. No.: 16/853,824

(22) Filed: Apr. 21, 2020

(65) Prior Publication Data

US 2020/0340502 A1 Oct. 29, 2020
US 2021/0262496 A9 Aug. 26, 2021

(30) Foreign Application Priority Data

Apr. 24, 2019 (EP) ..... 19170757

(51) Int. Cl.
*F15B 15/18* (2006.01)
*F15B 1/02* (2006.01)
*F15B 1/04* (2006.01)

(52) U.S. Cl.
CPC ..... *F15B 15/18* (2013.01); *F15B 1/021* (2013.01); *F15B 1/04* (2013.01)

(58) Field of Classification Search
CPC .... F15B 1/025; F15B 1/04; F15B 1/26; F15B 3/00; F15B 11/032; F15B 11/0325; F15B 15/18
See application file for complete search history.

(56) References Cited

U.S. PATENT DOCUMENTS 2,918,795 A * 12/1959 Marien ..... H02K 5/12 60/475
2,939,284 A * 6/1960 Gertz ..... G21C 7/16 60/390
4,030,299 A * 6/1977 Reuschel ..... B29C 45/67 60/560
5,170,691 A 12/1992 Baatrup
6,295,914 B1 10/2001 Iversen
6,796,120 B2 * 9/2004 Franchet ..... B64C 13/504 60/413

(Continued)

FOREIGN PATENT DOCUMENTS

CN 2601156 Y 1/2004
CN 102782335 A 11/2012

(Continued)

OTHER PUBLICATIONS

First Examination Report for Indian Patent Application No. 202014013890 dated Mar. 15, 2021.

*Primary Examiner* — Michael Leslie
*Assistant Examiner* — Matthew Wiblin
(74) *Attorney, Agent, or Firm* — McCormick, Paulding & Huber PLLC

(57) ABSTRACT

A hydraulic actuator arrangement (1) is described comprising a hydraulic actuator having a pressure chamber (2), a cylinder (3) in a cylinder housing (4), and a piston (5) connected to a piston rod, a hydraulic pump (7) connected to the pressure chamber (2) and an electric motor (8) driving the hydraulic pump (7), wherein the pump (7) and the motor (8) are arranged within the actuator. Such an actuator arrangement should have many application possibilities. To this end, a hydraulic pressure amplifier (10) is arranged between the hydraulic pump (7) and the pressure chamber (2).

22 Claims, 2 Drawing Sheets

(56) References Cited

U.S. PATENT DOCUMENTS

| | | | | |
|---|---|---|---|---|
| 2008/0289327 | A1* | 11/2008 | Mintgen | F15B 15/204 60/477 |
| 2011/0146262 | A1* | 6/2011 | Schmidt | F15B 15/1447 60/473 |
| 2012/0304633 | A1* | 12/2012 | Rozzi De Hieronymis | F15B 15/204 60/393 |
| 2016/0061233 | A1* | 3/2016 | Staab | F15B 15/1447 60/413 |
| 2017/0136519 | A1* | 5/2017 | Erlenmaier | B30B 1/323 |
| 2017/0321728 | A1* | 11/2017 | Iversen | F04B 7/04 |
| 2018/0106305 | A1 | 4/2018 | Baehr et al. | |

FOREIGN PATENT DOCUMENTS

| | | | | |
|---|---|---|---|---|
| DE | 102015217899 | A1 * | 6/2016 | F15B 21/0423 |
| DE | 102015217889 | A1 | 3/2017 | |
| DE | 102016224970 | A1 | 6/2018 | |
| EP | 1 806 506 | A2 | 7/2007 | |
| EP | 2868932 | A1 * | 5/2015 | F15B 15/18 |
| EP | 2868932 | A1 | 5/2015 | |
| EP | 3 318 768 | A1 | 5/2018 | |

* cited by examiner

HYDRAULIC ACTUATOR ARRANGEMENT

CROSS-REFERENCE TO RELATED APPLICATION

This application claims foreign priority benefits under 35 U.S.C. § 119 to European Patent Application No. 19170757.9 filed on Apr. 24, 2019, the content of which is hereby incorporated by reference in its entirety.

TECHNICAL FIELD

The present invention relates to a hydraulic actuator arrangement comprising a hydraulic actuator having a pressure chamber, a cylinder in a cylinder housing and a piston connected to a piston rod, a hydraulic pump connected to the pressure chamber, and an electric motor driving the hydraulic pump, wherein the pump and the motor are arranged with the actuator.

BACKGROUND

Such a hydraulic actuator arrangement is known, for example, from DE 10 2016 224 970 A1.

Such a hydraulic actuator arrangement can be realized in a rather compact unit. The compactness can be, however, in some cases a bar for the usability.

SUMMARY

The object underlying the invention is to provide an actuator arrangement with many application possibilities.

This is solved with a hydraulic actuator arrangement as described at the outset in that a hydraulic pressure amplifier is arranged between the hydraulic pump and the pressure chamber.

The hydraulic pressure amplifier can be used to increase the pressure supplied to the pressure chamber, so that the hydraulic actuator arrangement can be used despite its compactness to produce lager forces, for example to lift larger loads. With such an arrangement it is possible to have a hydraulic actuator arrangement having only electrical wires to the hydraulic actuator arrangement. No other energy supply is necessary. Anything else (components, hydraulic, etc.) can be contained in the actuator arrangement.

In an embodiment of the invention the pressure amplifier is arranged in the piston rod. In this way the pressure amplifier, which can be, for example, a pressure amplifier cartridge, does not need any additional space so that the compactness of the actuator arrangement can be maintained.

In an embodiment of the invention the motor and the pump are arranged in the piston rod. Again, the internal volume of the piston rod can be used to accommodate the motor and the pump, so that no additional space is needed. The pump can be, for example, a pump having a variable displacement. In an alternative embodiment, the pump can be a pump with a fixed displacement. In this case, the rotational speed of the electrical motor could be varied, for example by way of a frequency converter. In principle, any electric motor could be used.

When all components are integrated into the piston rod, it is possible to provide a "finished unit" which just needs to be placed in a corresponding cylinder.

In an embodiment of the invention the pressure amplifier comprises switching means which in response to a pressure in the pressure chamber activate or inactivate the pressure amplifier. In this way it is possible under "low load" conditions to supply "normal" pressure which can be produced by the hydraulic pump to the pressure chamber. Only in case where a higher pressure is required, the pressure amplifier is activated. Such an activation can be made automatically.

In an embodiment of the invention the motor is arranged in a section of the piston rod extending out of the cylinder in an extracted state of the piston rod. This has the advantage that the motor can be cooled by the ambient air when the piston rod is extracted.

In an embodiment of the invention the motor is arranged in a section of the piston rod surrounded by an oil volume, when the piston rod is in a retracted position. The motor is at least partly oil-cooled. In this way that is possible to prevent an overheating of the motor. The term "oil" is used as an abbreviation for "hydraulic fluid". It is of course possible to use other hydraulic fluids than oil.

In an embodiment of the invention the oil volume is unpressurized in a retracted position of the piston rod. This means that the oil can be kept at a low temperature.

In an embodiment of the invention an accumulator is arranged within the cylinder housing. The accumulator is used to balance the oil volume when the pressure chamber and a retraction chamber have different pressure areas.

In an embodiment of the invention the accumulator is arranged between the cylinder housing and the cylinder. The accumulator does not interfere with other parts of the actuator.

In an embodiment of the invention the accumulator is ring-shaped. In this way the whole outer circumference of the cylinder can be used to accommodate the accumulator.

In an embodiment of the invention the accumulator extends over the length of the cylinder. Thus, the accumulator can have a sufficiently large volume. The accumulator can be pressurized, if necessary, by a volume of air under a certain pressure.

In an alternative embodiment the pressure chamber is arranged with the piston rod.

In an embodiment of the invention a retraction chamber surrounds the piston rod, wherein a first pressure area of the retraction chamber is equal to a second pressure area of the pressure chamber. In this way it is possible to shift the oil from the pressure chamber to the retraction chamber or vice versa without the need for an additional space accommodating hydraulic oil.

In an embodiment of the invention a buffer tank is arranged within the piston rod. The buffer tank can be used for temperature and tolerance compensation without the necessity to accommodate a difference volume of oil or hydraulic fluid between the pressure chamber and the retraction chamber. Thus, the buffer tank can be kept quite small, so that the overall size of the actuator arrangement can be kept small as well.

In an embodiment of the invention a volume of compressed air limits the buffer tank. The air volume can be further compressed, when temperature or tolerance compensation needs a larger volume of the buffer tank or it can be expanded when the needed volume of the buffer tank decreases.

BRIEF DESCRIPTION OF THE DRAWINGS

Preferred embodiments of the invention will now be described in more detail with reference to the drawing, wherein.

DETAILED DESCRIPTION

Figure 1:
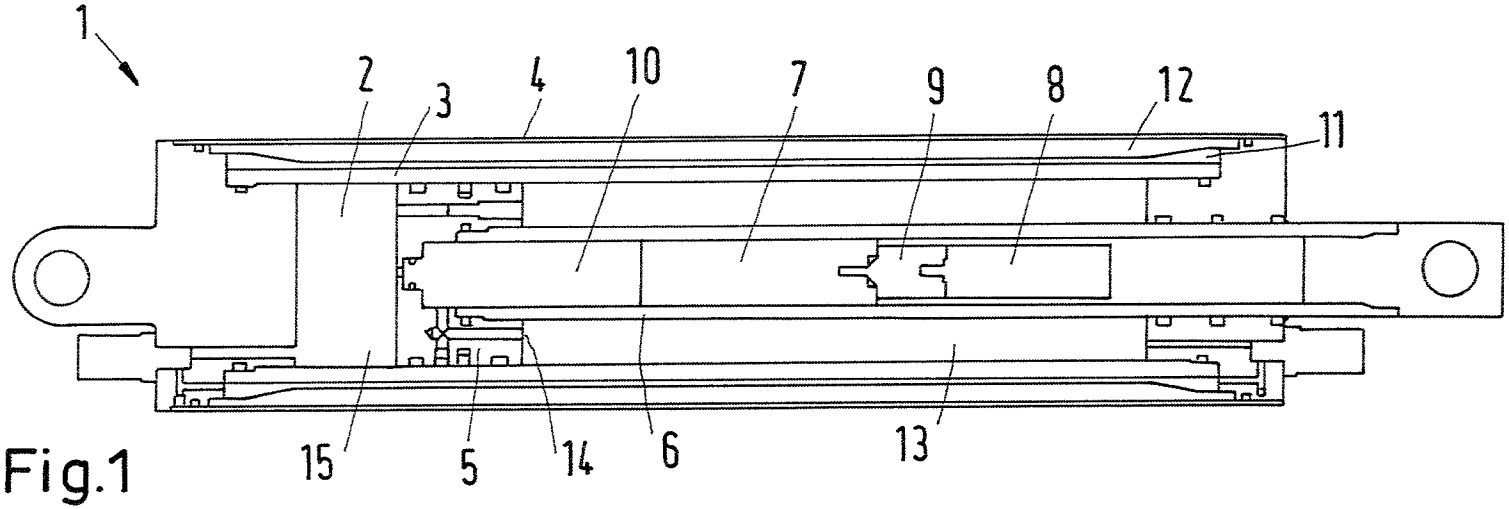
FIG. 1 shows schematically a first embodiment of a hydraulic actuator arrangement.

A hydraulic actuator arrangement 1 as shown in FIG. 1 comprises a hydraulic actuator having a pressure chamber 2 limited by a cylinder 3 in a cylinder housing 4 and a piston 5 connected to a piston rod 6.

The actuator arrangement 1 furthermore comprises a hydraulic pump 7 connected to the pressure chamber 2, and an electric motor 8 connected to the hydraulic pump 7, if necessary, via a gear 9.

The hydraulic pump 7 can be, for example, in form of a reversable piston pump or a bi-directional piston pump, i.e. the pump 7 is able to deliver hydraulic fluid in both directions.

It is also possible to use a gear pump.

In principle, any type of pump is possible. The pump can be a pump with variable displacement, so that the volume of hydraulic fluid supplied by the pump can be varied by varying the displacement. In an alternative the pump can be a pump with fixed displacement. In this case the volume of hydraulic fluid delivered by the pump can be varied by varying the rotational speed of the electric motor 8.

The electric motor 8 can be, for example, in form of a brushless motor. The gear 9 can be used to transform the rotational speed of the electric motor 8 into a different rotational speed of the pump 7. This speed is in most cases lower than the rotational speed of the electric motor 8.

The electric motor 8 can be a motor with a controlled and variable rotational speed. The variable rotational speed can be used in combination with a variable displacement pump or with a fixed displacement pump. In the latter case it is possible to vary the volume of hydraulic fluid delivered by the pump 7 using the electric motor 8.

A hydraulic pressure amplifier 10 is arranged between the pump 7 and the pressure chamber 2. The hydraulic pressure amplifier 10 is in form of a cartridge amplifier and is able to increase the pressure delivered by the pump 7 by a factor of more than 1. In an embodiment of the invention the pressure amplifier 10 increases the pressure by an intensification ratio from 2,5 to 3,5.

As it can be seen in the schematic illustration of FIG. 1, the pump 7, the electric motor 8 and the pressure amplifier 10 are arranged within the hydraulic actuator, more precisely within the piston rod 6.

One of the advantages when all components, i.e. pump 7, electric motor 8 and pressure amplifier 10, are integrated into the piston rod 6 are that it is possible to manufacture a "finished unit" which just needs to be placed in a corresponding cylinder 3.

It is of course possible to place the electric motor 8, the pump 7, and the pressure amplifier 10 outside the piston rod 6 or to use any combination of elements inside the piston rod 6 and other elements outside the piston rod 6. It is for example possible to place the electric motor 8 outside and the pump 7 and the pressure amplifier 10 inside the piston rod 6, even though this is not the preferred solution.

An accumulator 11 is arranged within the cylinder housing 4. The accumulator 11 is arranged between the cylinder housing 4 and the cylinder 3. The accumulator 11 is ring-shaped and extends basically over the length of the cylinder 3. A volume 12 of air is arranged between the cylinder housing 4 and the accumulator 11. When the accumulator 11 is filled with hydraulic fluid, the volume 12 of air is decreased.

A retraction volume 13 is arranged to surround the cylinder rod 6.

The electric motor 8 is arranged in a position in which heat can be removed from the motor 8. More precisely, the motor 8 is arranged in a section of the piston rod 6 extending out of the cylinder 3 when the piston rod 6 is extracted. In such a situation, the motor 8 is cooled by ambient air.

When the piston rod 6 is in the hydraulic fluid retracted position, as shown in FIG. 1, the motor 8 is cooled by the volume of oil in the retraction chamber (13). Since the hydraulic fluid in the retraction chamber 13 usually is in an unpressured state when the piston rod is extracted, the temperature of the hydraulic fluid is on a low lever, so that the motor 8 can sufficiently be cooled.

The pressure chamber 13 has a first pressure area 14 at the piston 5 and the pressure chamber 2 has a second pressure area at the piston 5. As can be seen in FIG. 1, the first pressure area 14 is smaller than the second pressure area 15. Thus, when the piston rod 6 is extracted and the pressure chamber 2 enlarges its volume, the volume delivered from the retraction chamber 13 is not sufficient to completely fill the pressure chamber 2. The missing oil is taken out of the accumulator 11.

On the other hand, when the piston rod 6 is retracted to the position shown in FIG. 1, the volume of hydraulic fluid displaced out of the pressure chamber 2 is larger than the volume which can be accommodated in the retraction chamber 13. The difference is supplied to the accumulator 11.

Figure 2:
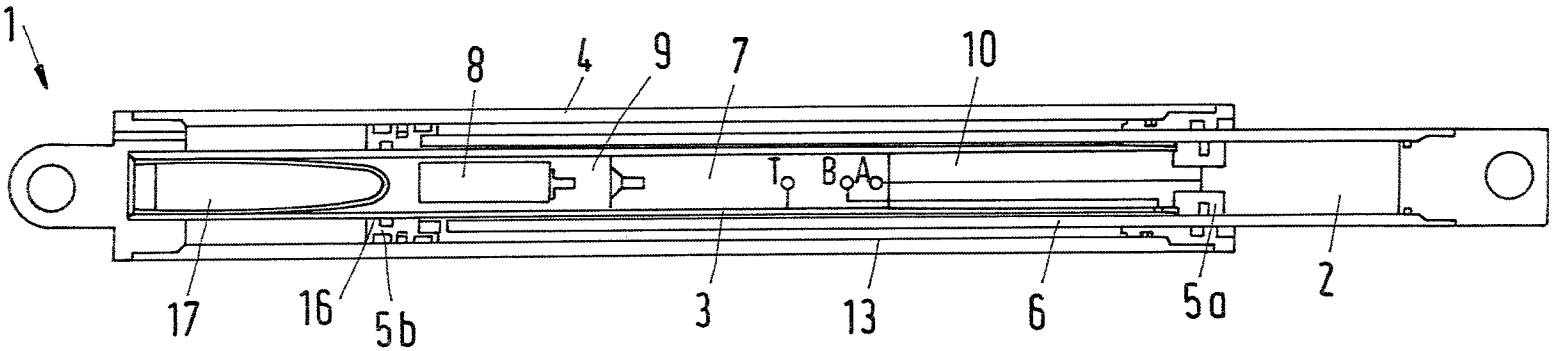
FIG. 2 shows schematically a second embodiment of a hydraulic actuator arrangement.

FIG. 2 shows a second embodiment, in which the same elements as in FIG. 1 are denoted with the same reference numerals.

In the second embodiment the pressure chamber 2 is arranged within the piston rod 6. On the other hand, the piston is divided in two piston parts 5*a*, 5*b*. This makes it possible to design the hydraulic actuator arrangement 1 in a way, in which the cross-sectional area of the pressure chamber 2 and of the retraction chamber 13 are equal. Thus, when the piston rod 6 is extracted out of the cylinder housing 4 the hydraulic fluid needed to fill the pressure 2 can be taken out of the retraction chamber 13 and the same is true for the movement in the other direction. Hydraulic fluid coming out of the pressure chamber 2 can be displaced into the retraction chamber 13.

A buffer tank 16 is provided for temperature and tolerance compensation. The pressure in the buffer tank 16 can be kept at 0 bar. A volume 17 of compressed air is provided in the buffer tank 16.

In both embodiments the pump 7 can deliver hydraulic fluid in both directions, so that the piston rod 6 can be extracted when the pressure chamber 2 is pressurized and can be retracted, when the retraction chamber 13 is supplied with hydraulic fluid under a certain pressure. However, since the pressure needed for the retraction of the piston rod 6 is in many cases not so high, it is in these cases not necessary that the hydraulic pressure amplifier 10 amplifies hydraulic fluid in a direction towards the retraction chamber. Amplification of the pressure is performed only in a direction towards the pressure chamber 2, if necessary.

Figure 3:
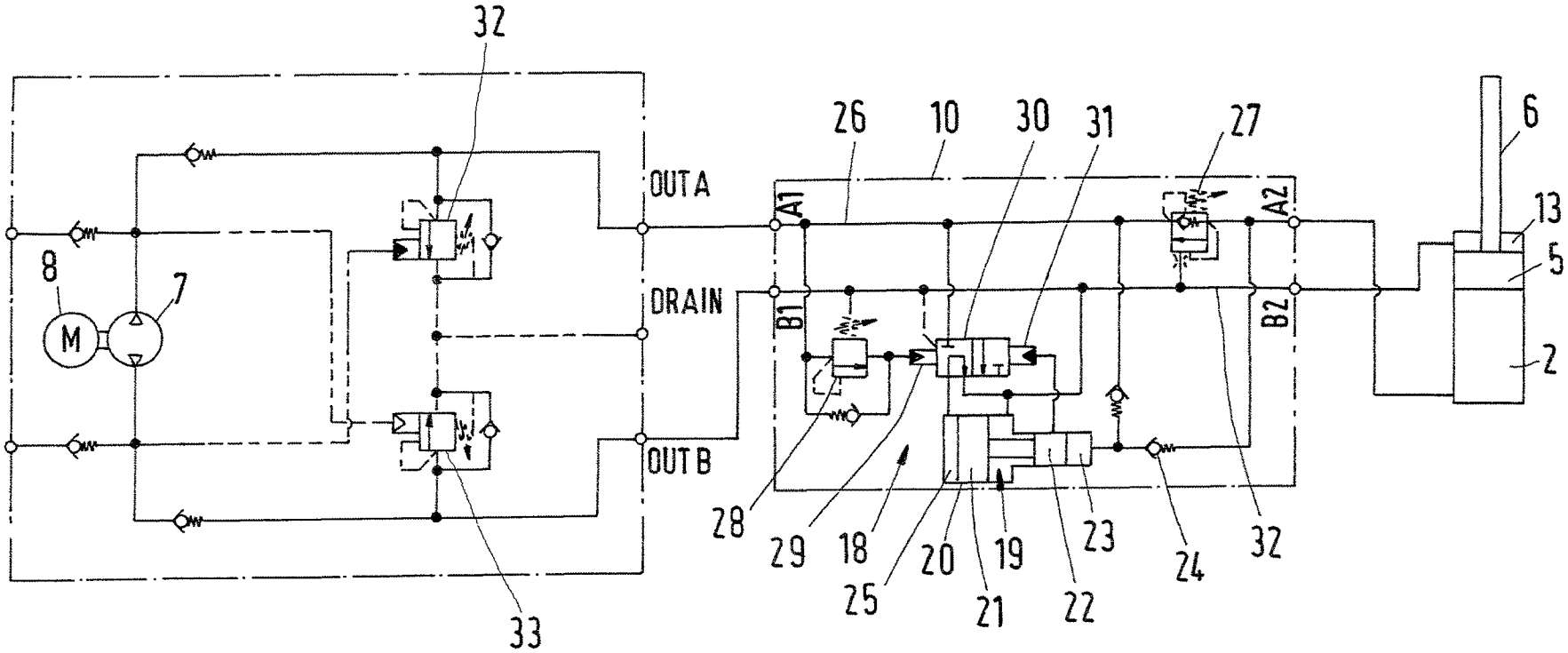
FIG. 3 shows schematically a circuit diagram of a hydraulic actuator arrangement.

FIG. 3 schematically shows a circuit diagram of the hydraulic actuator arrangements of FIGS. 1 and 2. The same elements are denoted with the same reference numerals.

The pressure amplifier 10 comprises an amplification unit 18 having an amplification piston 19 arranged in an amplification cylinder 20.

The amplification piston 19 comprises a low-pressure part 21 and a high-pressure part 22. The low-pressure part 21 has a larger pressure area than the high-pressure part 22. The high-pressure part 22 is moveable in a high-pressure cylinder 23 which is connected to the pressure chamber 2 of the actuator. A check valve 24 is arranged between the high-pressure cylinder 23 and the pressure chamber 2.

The low-pressure part 21 is moveable in a low-pressure cylinder 25 which is connected to a supply line 26 connecting an output A of the pump 7 and the pressure chamber 2 via an activation valve 27. When the pressure in the pressure chamber 2, more precisely a pressure at an output A2 of the pressure amplifier 10 connected to the pressure chamber 2 exceeds a predetermined pressure, the supply line 26 is interrupted and hydraulic fluid amplified by the amplification unit 18 is delivered to the output A2.

The amplification unit 18 in turn is activated by a sequence valve 28. When the pressure in supply line 26 (in the part between the pump 7 and the activation valve 27) increases, the sequence valve 28 pressurizes a first control port 29 of a control valve 30. The control valve 30 comprises a second control port 31 connected to the high-pressure cylinder 23.

When the activation valve 27 has interrupted the supply line 26, the hydraulic fluid supplied by the pump 7 reaches the high-pressure cylinder 23 via a check valve and acts on the high-pressure part 22 of the amplification piston 19 to move it in a direction in which the volume of the low-pressure cylinder 25 is decreased. After a certain movement the high-pressure cylinder 23 is connected to the second control part 31 and the control valve 30 is switched so that a connection between the supply line 26 and the low-pressure cylinder 25 is established. Since the pressure area of the low-pressure part 21 of the amplification piston 19 is larger than the pressure area of the high-pressure part 22, the amplification piston 19 changes the direction of movement and decreases the volume of the high-pressure cylinder 23 thereby delivering hydraulic fluid under an elevated pressure to the pressure chamber 2. This movement is continued until the high-pressure part 22 releases a connection between the second control port 31 and a drain line 32 having a low pressure. The control valve 30 switches into the other position in which the low-pressure cylinder 25 is connected to the drain line 32 and the amplification piston 19 can be moved in a direction to decrease the volume of the low-pressure cylinder 25.

When the direction of movement of the piston 5 should be reversed, the motor 8 reverses its direction of rotation and the pump 7 supplies hydraulic fluid into the drain line 32 connected to the retraction chamber 13. The pressure in the pressure chamber 2 opens the activation valve 27 so that hydraulic fluid displaced out of the pressure chamber 2 is fed back to the pump 7.

By way of example, valves 32, 33 are shown (in this embodiment as counterbalance valves) to allow a flow of fluid in one direction into the pressure chamber 2 and out of the retraction chamber 13 and in the other direction out of the pressure chamber 2 and into the retraction chamber 13.

In order to simplify the explanation, the accumulator 11 is not shown here.

In a way not shown, it is possible to connect the pressure amplifier 10 to control of the motor 8 to supply information to the control whether the pressure amplifier 10 is active or not. In some cases, it is of advantage to increase the output pressure of the motor 8 when the pressure amplifier 10 has been activated.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic actuator arrangement comprising a hydraulic actuator having a pressure chamber, a cylinder in a cylinder housing, and a piston connected to a piston rod, a hydraulic pump connected to the pressure chamber, and an electric motor driving the hydraulic pump, wherein the pump and the motor are arranged within the actuator, wherein a hydraulic pressure amplifier is arranged within the hydraulic actuator between the hydraulic pump and the pressure chamber, and wherein the hydraulic pressure amplifier is a pressure amplifier cartridge.

2. The actuator arrangement according to claim 1, wherein the pressure amplifier is arranged in the piston rod.

3. The actuator arrangement according to claim 2, wherein the motor and the pump are arranged in the piston rod.

4. The actuator arrangement according to claim 2, wherein the pressure amplifier comprises switching means which in response to a pressure in the pressure chamber activate or inactivate the pressure amplifier.

5. The actuator arrangement according to claim 2, wherein the motor is arranged in a section of the piston rod extending out of the cylinder in an extracted state of the piston rod.

6. The actuator arrangement according to claim 1, wherein the motor and the pump are arranged in the piston rod.

7. The actuator arrangement according to claim 6, wherein the pressure amplifier comprises switching means which in response to a pressure in the pressure chamber activate or inactivate the pressure amplifier.

8. The actuator arrangement according to claim 1, wherein the pressure amplifier comprises switching means which in response to a pressure in the pressure chamber activate or inactivate the pressure amplifier.

9. The actuator arrangement according to claim 1, wherein the motor is arranged in a section of the piston rod extending out of the cylinder in an extracted state of the piston rod.

10. The actuator arrangement according to claim 1, wherein the motor is arranged in a section of the piston rod surrounded by an oil volume, when the piston rod is in a retracted position.

11. The actuator arrangement according to claim 10, wherein the oil volume is unpressurized in the retracted position of the piston rod.

12. The actuator arrangement according to claim 1, wherein an accumulator is arranged within the cylinder housing.

13. The actuator arrangement according to claim 12, wherein the accumulator is arranged between the cylinder housing and the cylinder.

14. The actuator arrangement according to claim 12, wherein the accumulator is ring-shaped.

15. The actuator arrangement according to claim 12, wherein the accumulator extends over the length of the cylinder.

16. The actuator arrangement according to claim 1, wherein the pressure chamber is arranged within the piston rod.

17. The actuator arrangement according to claim 16, wherein a retraction chamber surrounds the piston rod, wherein a first pressure area of the retraction chamber is equal to a second pressure area of the pressure chamber.

18. The actuator arrangement according to claim 16, wherein a buffer tank is provided.

19. The actuator arrangement according to claim 18, wherein a volume of compressed air limits the buffer tank.

20. The actuator arrangement according to claim 1, wherein the motor and pump travel with the piston rod.

21. The actuator arrangement according to claim 1, wherein the hydraulic pressure amplifier comprises a control valve configured to connect a low-pressure cylinder of the hydraulic pressure amplifier to a supply line in a first position and to connect the low-pressure cylinder to a drain line in a second position.

22. A hydraulic actuator arrangement comprising a hydraulic actuator having a pressure chamber, a cylinder in a cylinder housing, and a piston connected to a piston rod, a hydraulic pump connected to the pressure chamber, and an electric motor driving the hydraulic pump, wherein the pump and the motor are arranged within the actuator, wherein a hydraulic pressure amplifier is arranged within the hydraulic actuator between the hydraulic pump and the pressure chamber, and wherein the motor is arranged in a section of the piston rod extending out of the cylinder in an extracted state of the piston rod.

* * * * *